United States Patent [19]

Voosen

[11] Patent Number: 4,949,073

[45] Date of Patent: Aug. 14, 1990

[54] GLASS BREAKAGE DETECTOR WITH SELF-ALIGNING HOUSING

[75] Inventor: Robert C. Voosen, Newtown, Mass.

[73] Assignee: International Electronics, Inc., Needham Heights, Mass.

[21] Appl. No.: 295,650

[22] Filed: Jan. 10, 1989

[51] Int. Cl.[5] ..... G08B 13/04

[52] U.S. Cl. ..... 340/550; 310/348; 340/693

[58] Field of Search ..... 340/550, 693; 310/348

[56] References Cited

U.S. PATENT DOCUMENTS 3,863,250 1/1975 McCluskey, Jr. ..... 340/550
4,054,867 10/1977 Owens ..... 340/550
4,112,420 9/1978 Mifune et al. ..... 340/550

*Primary Examiner*—Glen R. Swann, III.
*Attorney, Agent, or Firm*—Robert F. O'Connell

[57] ABSTRACT

A glass fracture detection system includes a circuit having a sensor for providing an output signal when a glass fracture occurs. The sensor is positioned within a housing so that, when the housing is mounted on the surface of the glass adjacent the frame in which the glass is encased, the sensor is automatically positioned in communication with the glass surface at a specified distance from the frame, which distance is selected so as to reduce damping of the output signal due to the presence of the frame and to reduce signals reflected from the frame to the sensor.

9 Claims, 2 Drawing Sheets

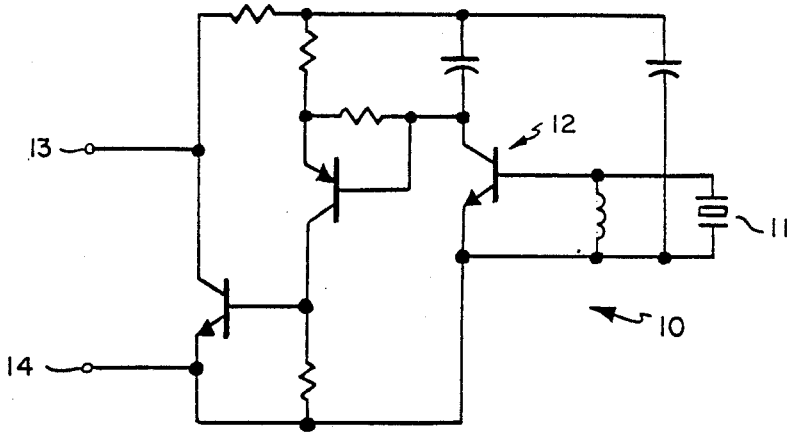
FIG. 1 PRIOP ART
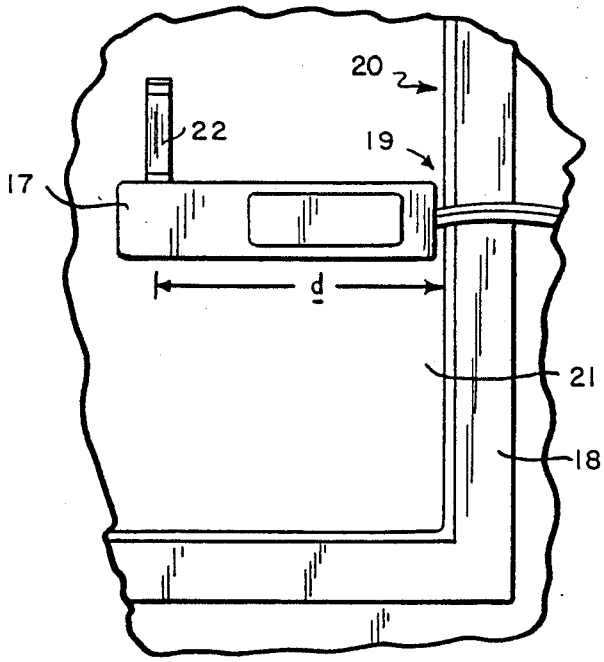
FIG. 3
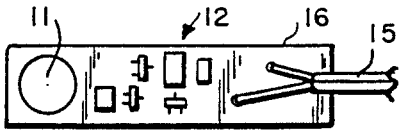
FIG. 2

GLASS BREAKAGE DETECTOR WITH SELF-ALIGNING HOUSING

INTRODUCTION

This invention relates generally to glass fracture, or glass breakage, detection systems and, more particularly, to a glass fracture detection system having a unique configuration and operation for use as part of an intruder alarm system.

BACKGROUND OF THE INVENTION

Glass breakage detectors have been used for many years as part of intruder alarm systems some of which, for example, include a piezo-electric transducer detection element for sensing when a glass, such as a glass window, either cracks or breaks. The piezo-electric detector element is normally affixed directly to the surface of the glass and senses the presence of a mechanical wave signal which is a specific harmonic of the ultrasonic frequency mechanical wave signals which are transmitted through the glass when it fractures. The detector must normally be in a location on a glass window, for example, which is sufficiently removed from the frame in which the glass is encased in order to reduce the damping which may be imposed on the signal to be detected because of the presence of the frame structure and in order to reduce signals that may be reflected from the frame structure to the detector element. On the other hand, it is desirable that the detector be installed relatively near the frame for appearance's sake.

Accordingly, an installer must specifically determine the distance for such a desired minimum offset from the frame and then measure such distance during installation. Alternatively, an installer may estimate such minimum distance, permitting some degree of error on the high side, in order to locate the detector at a suitable region of the window. In the former case, the installer requires appropriate tools and time for installation, while, in the latter case, if the detector is positioned too far from the frame, the installed detector will require the presence of an undesired extra length of wire across the glass, which exposed wire will not only be unsightly, but can also interfere with cleaning of the glass and may even tend to encourage tampering and vandalism.

It is desirable then to provide a glass breakage detection system which can easily be correctly positioned relative to the frame and which, at the same time, can provide a satisfactory appearance and eliminate the need for leaving a length of wire across the glass.

Further, in currently available glass breakage detection systems, testing can be performed by electronically generating a simulated glass breakage wave signal and applying the simulated signal to the detection system in order to insure that the detection system is functioning properly.

It is desirable that the system be arranged to be tested regularly over the course of time in a relatively easy manner, i.e., one which does not require the breaking of a glass sample or the use of simulated signal generation equipment. If the system permits a relatively easy test to be performed, it is more likely that a user will do so, particularly if testing requires no such glass destruction or no extra tools or excessive time for such purpose.

BRIEF SUMMARY OF THE INVENTION

In accordance with the invention, a glass breakage detection system is arranged so as to use an overall housing structure such that when the structure is positioned on the glass adjacent the frame, the detector element within the structure is automatically positioned at the specified correct distance from the frame and is also correctly aligned in a perpendicular direction with respect to the frame to provide a satisfactory appearance of the system. Moreover, such structure permits any wiring required to be brought out from the system to be taken off at the frame end thereof and either inserted directly into a hole drilled into the frame or directed over the edge of the frame for surface wiring in a manner such that it can be generally hidden from view. Accordingly, the need for using unsightly wires across the glass surface itself is eliminated.

Further, the detection system of the invention incorporates a testing device as a part of the overall housing structure which testing device is very easy to use and requires no glass shattering to take place or extra equipment to be needed for such test purposes.

BRIEF DESCRIPTION OF THE DRAWINGS

The invention can be described in more detail with the help of the accompanying drawings wherein FIG. 1 shows a schematic diagram of exemplary circuitry for use in the device of the invention;

FIG. 2 shows a plan view of the elements of such circuitry on a substrate for use in the device of the invention;

FIG. 3 shows a plan view of the device of the invention as used in a window frame;

DESCRIPTION OF THE PREFERRED EMBODIMENT

Figure 4A:
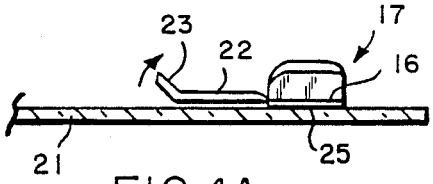
FIGS. 4A and 4B show end views of the device of the invention illustrating the use of the testing element thereof.

FIG. 1 shows an exemplary schematic circuit diagram of a glass breakage detection circuit 10 for use in the invention utilizing a piezo-electric transducer element 11 for detecting glass fracture. The electrical output from piezo-electric element 11 is supplied to conventional amplifier and filter circuitry 12 of a type well known to those in the art. The amplified and filtered output of circuitry 12 is supplied at terminals 13 and 14, to which are connected appropriate wires or leads for supplying the output signal to a suitable alarm device (not shown) which provides, for example, an audible or visual alarm, or both. The circuitry shown in FIG. 1 is known and is exemplary only and does not in itself constitute the inventive aspect of the glass breakage detection system of the invention.

In accordance with the invention, the circuitry is provided on a suitable substrate, or board, 16 shown in plan view in FIG. 2, the wire leads 15 extending from the board for use externally to the detection unit. The circuit board depicted in FIG. 2 may be of a ceramic or a fiberglass reinforced material, for example, and is formed as the bottom of an appropriate housing structure 17 having an opening at one end thereof through which the wiring can extend.

Figure 4B:
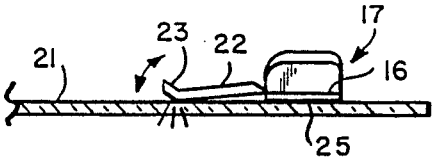
Figure 5A:
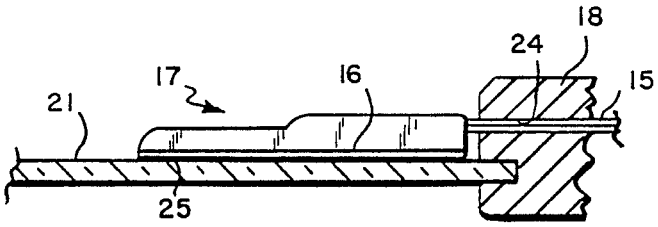
FIGS. 5A and 5B show side views of the device of the invention depicting different ways of arranging the output wiring therefrom.
Figure 5B:
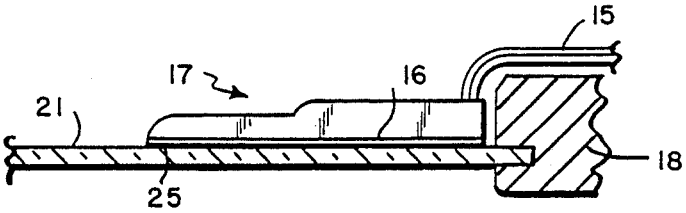

A plan view of the housing structure 17 is shown in FIG. 3 positioned in a window frame 18 and side views thereof are shown in FIGS. 5A and 5B. The housing structure is positioned on the glass surface of the window and is adhered thereto in any suitable manner, one end 19 thereof being positioned adjacent a side 20 of frame structure 18. The piezo-electric element is, accordingly, placed in communication with the surface of the glass window 21 through the substrate 16. The latter is adhered to the glass surface, preferably using a suitable peel-and-stick type of adhesive film of substantially uniform thickness which is affixed to the bottom of the substrate. For installations, the covering thereof is peeled, or stripped, off and the exposed adhesive 25 is then used to adhere the substrate to the glass surface, as would be known to those in the art, as best seen in FIGS. 4A and 4B or in FIGS. 5A and 5B, for example. The use of such adhesive film permits the housing to be adhered to the glass surface and also permits the piezo-electric element to be suitably coupled in communication with the glass surface so as to be responsive to the mechanical wave signal generated in the glass upon fracture thereof.

The dimensions of the housing are arranged so that, when placed in the position shown in FIG. 3, the piezo-electric element therein is at a desired, pre-selected specified distance "d" from the side 20 of frame 18, as shown.

A semi-rigid, but relatively flexible, strip 22 of a suitable material, such as a semi-rigid plastic material is fixedly attached in any suitable manner to a side of housing 17 at or near one end thereof, or, alternatively, it is otherwise integrally formed with the housing 17 itself, as shown both in FIG. 3 and in FIGS. 4A and 4B. The latter figures, for example, show the housing looking from one end thereof. The strip, or testing tab, 22 preferably has a curved, or otherwise bent, end portion 23, as shown, projecting upwardly from the glass surface 21. The tab is used for testing the operation of the glass breakage detection system as follows.

When the plastic tab 22 is lifted away the surface of the glass in the direction of the arrow in FIG. 4A and is then released, it will snap against the glass surface, as shown in FIG. 4B, and will generate mechanical wave signals at ultrasonic frequencies which signals travel within the glass toward the piezo-electric element. One of the ultrasonic signals which is communicated through the glass to the piezo-electric sensing element will have a frequency which corresponds to the resonant frequency to which the detector element responds The circuitry in FIG. 1 responds thereto so as to produce an output signal in a manner substantially the same as would be produced if the glass itself became fractured. The mere snapping of the test tab against the glass surface provides a very easy-to-use integrally formed testing device which produces a desired signal for testing the operation of the detection circuitry, without the need to break the glass or to use any extra tools for such purpose.

As seen more specifically in FIGS. 5A and 5B, the housing is arranged so that the wires 15, which are attached to the output terminals of the detection circuitry and formed as a cable structure, either can be inserted directly into a hole 24, which is drilled in the window frame 18, for connection to a suitable alarm device (FIG. 5A) or can be directed over the edge of the frame 18 for connection to a suitable alarm device, (FIG. 5B). In either case, there will be no exposed wires extending across the surface of the glass, as would normally be present in conventional glass breakage detection systems.

In summary, the structure described in accordance with the invention is, in effect, self-aligning with respect to the window frame and is self-distancing in that, when installed as shown in FIG. 3, for example, the piezo-element 11 is positioned at a desired correct minimum distance from the frame. Moreover, the system includes an easy-to-use testing device, permitting a user readily to make regular tests with little or no trouble or inconvenience. Moreover, the device of the invention does not utilize any wires or cables which lie in an exposed position on the glass surface, which exposure would not only be unsightly, but would tend to interfere with window cleaning and would invite tampering.

While the particular embodiment of the invention as shown and described above represents a preferred embodiment thereof, modifications may occur to those in the art within the spirit and scope of the invention. Accordingly, the invention is not to be construed as limited to the specific embodiment disclosed, except as defined by the appended claims.

I claim:

1. A glass fracture detection system for use with a glass encased in a frame, said system comprising circuit means, including a sensor element for sensing a fracture of said glass, for providing an output signal when a glass fracture occurs;

housing means containing said circuit means, the sensor element thereof being positioned within said housing means so that, when said housing means is mounted on the surface of said glass adjacent said frame, the sensor element is automatically positioned in communication with said glass surface at a specified distance from said frame, which distance is selected so as to reduce damping of said output signal by said frame and to reduce signals reflected from said frame to the sensor element.

2. A glass fracture detection system in accordance with claim 1 and further including wiring means connected to the output signal of said circuit means and extending outwardly from said housing to said frame for connection to an alarm device.

3. A glass fracture detection system in accordance with claim 2 wherein said wiring means either extends substantially directly into and through an opening in said frame or extends around and external to said frame.

4. A glass fracture detection system in accordance with claim 1 wherein said sensing element is a piezo-electric transducer element.

5. A glass fracture detection system in accordance with claim 1 and further including testing means integrally formed with said housing means.

6. A glass fracture detection system in accordance with claim 5 wherein said testing means includes means for providing a test signal directly at said glass.

7. A glass fracture detection system in accordance with claim 6 wherein said testing means comprises a flexible member attached at one end to said housing means, the other end of said flexible member being freely movable so that said member can be snapped against the surface of the glass to generate mechanical wave signals simulating wave signals generated when a fracture of said glass occurs, said sensing element being responsive to at least one of said mechanical wave signals.

8. A glass fracture detection system in accordance 7 wherein said flexible member is a semi-rigid plastic tab element.

9. A glass fracture detection system in accordance with claim 1 wherein said housing means includes a peel-and-stick adhesive material on one surface thereof for use in adhering said housing means to the surface of said glass and in providing a suitable coupling for communication between the glass surface and said sensor element in said housing means.

* * * * *